US007284714B1

(12) United States Patent
Wang et al.

(10) Patent No.: US 7,284,714 B1
(45) Date of Patent: Oct. 23, 2007

(54) WATER SHUTOFF AND DISCHARGE CONTROL APPARATUS FOR SPRINKLERS

(75) Inventors: King Yuan Wang, Changhua Hsien (TW); Shun Nan Lo, Changhua Hsien (TW); Chi Han Cheng, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 0 days.

(21) Appl. No.: 11/486,220

(22) Filed: Jul. 14, 2006

(30) Foreign Application Priority Data

Mar. 24, 2006 (TW) ..... 95110268 A

(51) Int. Cl.
*A62C 37/20* (2006.01)

(52) U.S. Cl. ..... 239/562; 239/240; 239/242; 239/443; 239/551; 239/566; 239/583; 239/586; 239/DIG. 1

(58) Field of Classification Search ..... 239/237, 239/240, 242, 436, 443, 444, 551, 562–564, 239/566, 583, 586, DIG. 1
See application file for complete search history.

(56) References Cited

U.S. PATENT DOCUMENTS 3,212,719 A * 10/1965 Di Corpo ..... 239/562
5,042,719 A * 8/1991 Magris et al. ..... 239/242
5,052,622 A * 10/1991 Lindermeir et al. ..... 239/242
5,305,956 A * 4/1994 Wang ..... 239/242
5,350,115 A * 9/1994 Burnworth et al. ..... 239/242
5,511,727 A * 4/1996 Heren et al. ..... 239/562
5,562,247 A * 10/1996 Roman ..... 239/240
5,628,458 A * 5/1997 Kuo ..... 239/242
5,657,928 A * 8/1997 Jian ..... 239/566
5,735,462 A * 4/1998 Roman ..... 239/242
6,736,340 B1 * 5/2004 Wang ..... 239/551

* cited by examiner

*Primary Examiner*—Steven J. Ganey
(74) *Attorney, Agent, or Firm*—Troxell Law Office, PLLC

(57) ABSTRACT

A water shutoff and discharge control apparatus for sprinklers comprises a water intake apparatus mounted to a support seat and swung back-and-forth by a sprinkling control assembly. The water intake apparatus has a tube with a platform and multiple outlets thereon, and both end sections of the tube have multiple control channels each connecting to the interior of the tube for the extension of a control rod there-through. Each control rod has a flat surface with a water-sealing member and a water-sealing area disposed thereon to match to the outlet, permitting the water-sealing member to abut watertight against an internal plane surface of the platform and slide along with the movement of the control rod to correspond to the outlet for water shutoff/discharge control thereby. Besides, the contact area between the control rod and the platform can be reduced, facilitating easier and more efforts-saving operation of the control rod thereby.

11 Claims, 11 Drawing Sheets

WATER SHUTOFF AND DISCHARGE CONTROL APPARATUS FOR SPRINKLERS

BACKGROUND OF THE INVENTION

The present invention relates to a water shutoff and discharge control apparatus for sprinklers, utilizing multiple control rods each having a flat surface kept in an appropriate space from an internal plane surface defining a platform of a tube with only a water-sealing member closely abutted against therewith to control the shutoff and discharge of water flow thereby, reducing the contact area between the control rod and the platform of the tube so as to cut down the frictional coefficient for efforts-saving operation of the control rod and achieving better waterproof effect thereby.

A conventional sprinkler 10 as disclosed in a Taiwan Patent, publication No. 1241157, and a US Patent, publication No. 6736340B1, includes a control rod 30 with a neck 33 that is corresponded to a seal 20 equipped with outlets 21 and a saddle 25 so as to control the water discharge via the outlets 21 thereof. However, in operation, the body of the control rod 30 must be completely abutted and wrapped at the saddle 25 of the seal 20 thereon, which will increase the contact area between the rod body and the saddle 25 and thus augment the frictional coefficient thereby. As a result, a lot of efforts must be spent to push the control rod 30 in operation. Besides, the rod body and the saddle 25 contact with each other in an arcuate abutment, which will increase the frictional resistance. Therefore, in case of high water pressure, the strong current will flush along the periphery of the control rod to buffet the inner side of the saddle 25 and infiltrate into the outlets 21 via the chinks between the rod body and the saddle 25 thereof, which makes the control rod 30 ineffective to avoid leakage in case of high water pressure.

SUMMARY OF THE PRESENT INVENTION

It is, therefore, the primary purpose of the present invention to provide a water shutoff and discharge control apparatus for sprinklers, utilizing multiple control rods each having a flat surface kept in an appropriate space from an internal plane surface defining a platform of a tube with only a water-sealing member closely abutted against therewith to control the shutoff and discharge of water flow thereby so that the contact area between the control rod and the platform of the tube can be reduced and the frictional coefficient thereof can be relatively cut down for easier and more efforts-saving operation of the control rod thereby.

It is, therefore, the second purpose of the present invention to provide a water shutoff and discharge control apparatus for sprinklers wherein the water-sealing member thereof is sandwiched between the flat surface of the control rod and the internal plane surface of the platform of the tube in flat abutment therewith, permitting the water-sealing member to evenly abut watertight against the internal plane surface of the platform no matter in high or low water pressure so as to avoid the risk of water leaking in case of high water pressure, achieving better waterproof effect thereby.

DETAILED DESCRIPTION OF THE PREFERRED EMBODIMENTS

Figure 1:
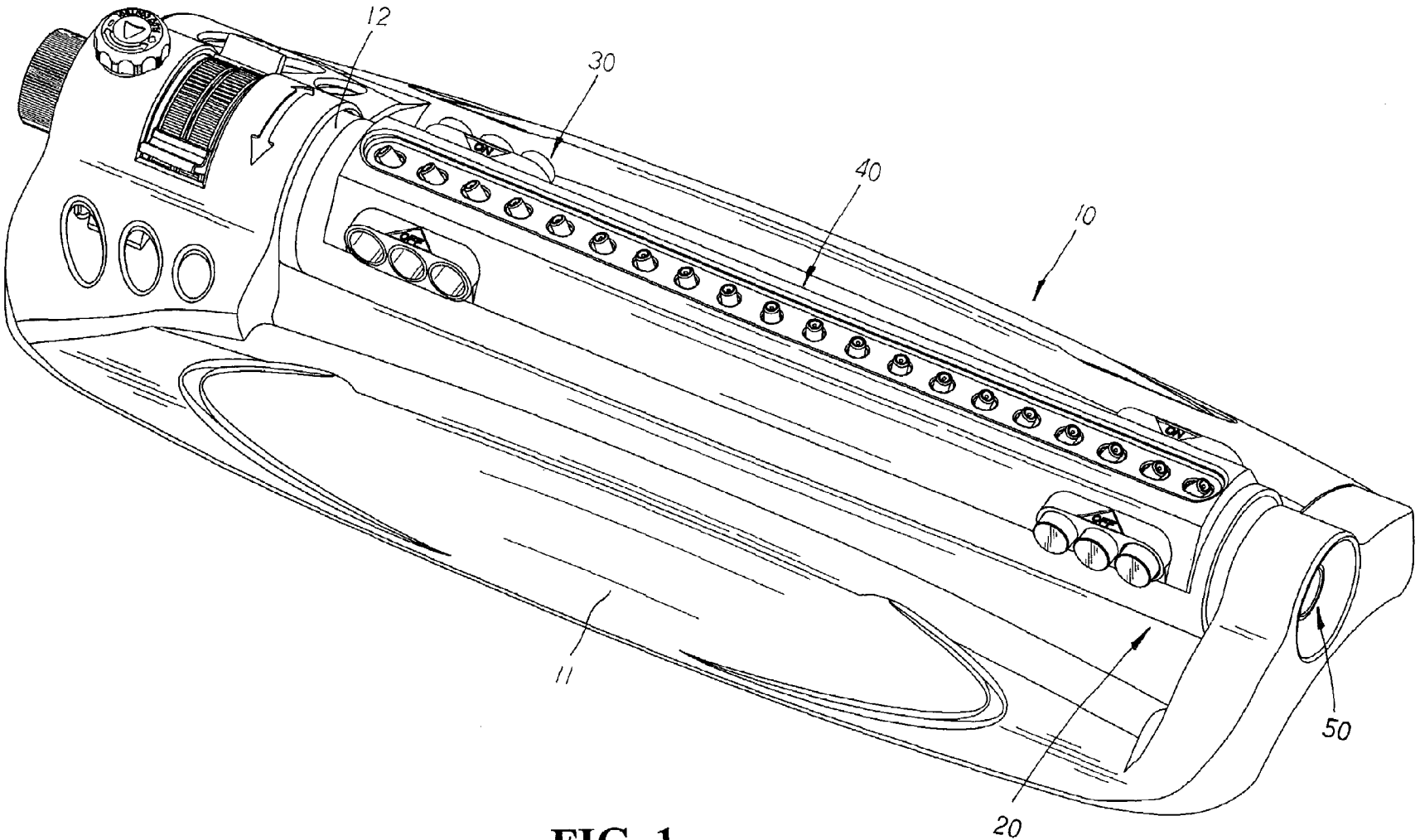
FIG. 1 is a perspective view of a sprinkler of the present invention.
Figure 2:
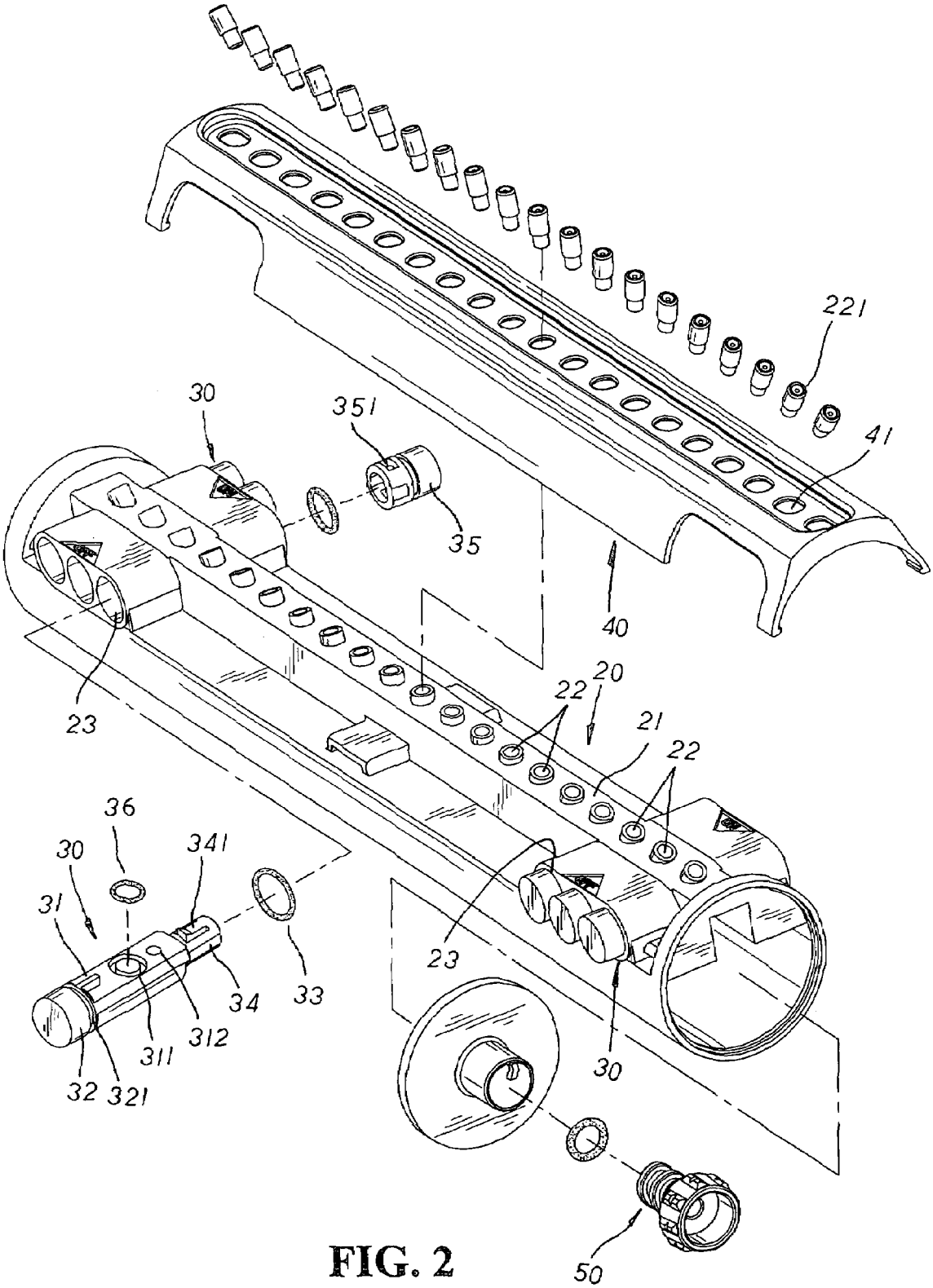
FIG. 2 is an exploded perspective view of the present invention.
Figure 3:
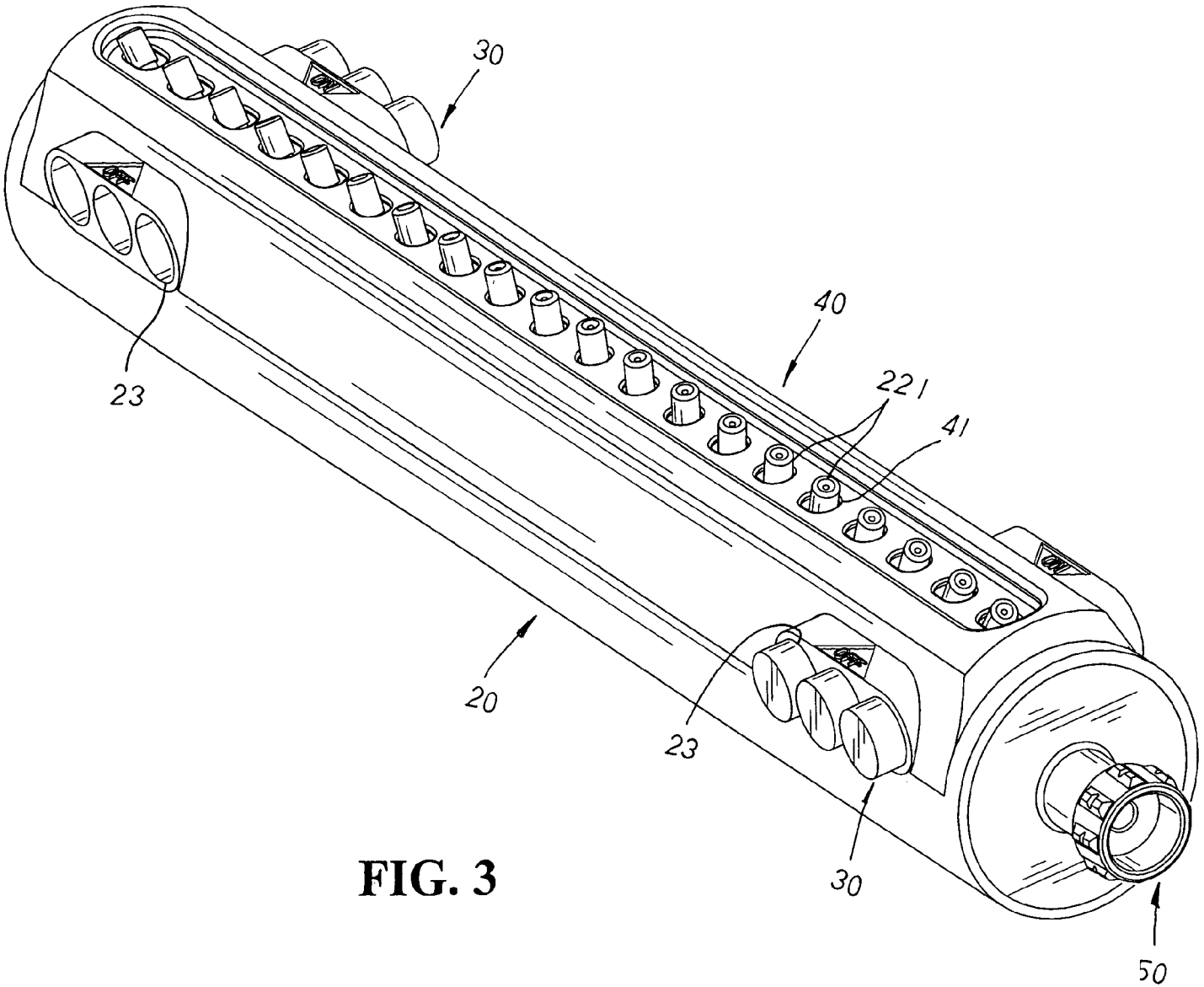
FIG. 3 is an assembled perspective view of the present invention.
Figure 4:
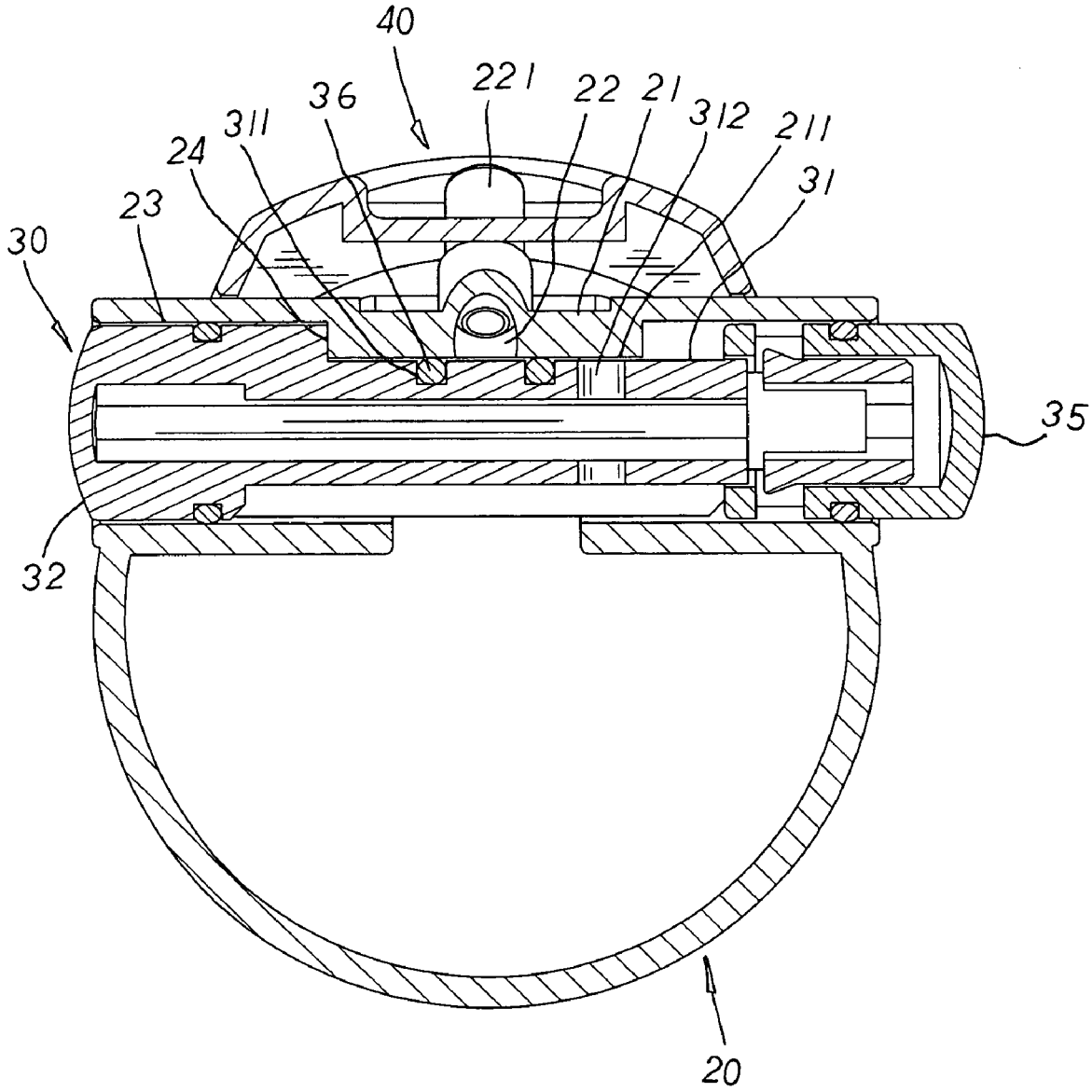
FIG. 4 is an assembled cross sectional view of the present invention shut off in water discharge.
Figure 5:
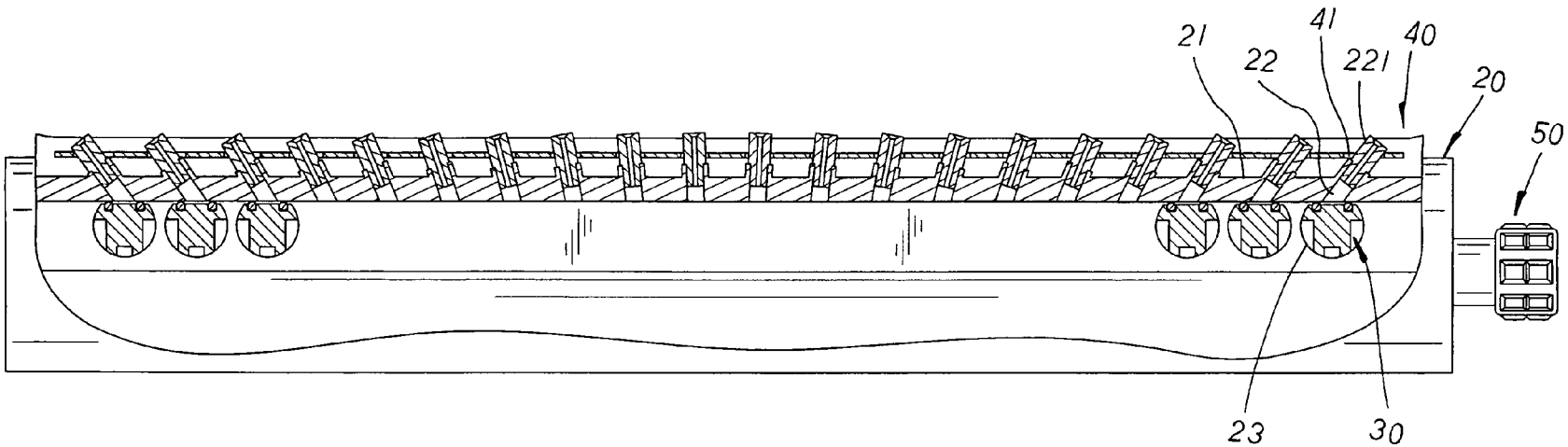
FIG. 5 is an assembled cross sectional view of a nozzle housing of the present invention mounted on top of a tube with nozzle sleeves guided to extend outwards there-through and the nozzle sleeves arranged at both sides to incline sequentially towards both outer sides.

Please refer to FIG. 1 showing a perspective view of a sprinkler of the present invention (accompanied by FIGS. 2, 3). The present invention relates to a water shutoff and discharge control apparatus for sprinklers, comprising a sprinkler 10, and a water inlet apparatus made up of a tube 20, multiple control rods 30, and a nozzle housing 40 to be transversely mounted to a support seat 11 thereon. A sprinkling control assembly 12 fluidly connected to the water supply is attached to one end of the water inlet apparatus to swing the water inlet apparatus back-and-forth into different angles, and a sealing cover 50 is jointed to the other end of the water inlet apparatus to form an enclosed end thereby. The tube 20 has a top side cut into a platform 21 with a plane surface 211 defining the internal wall thereon, and a plurality of outlets 22 drilled on the top surface of the platform 21 thereon each for the mounting of a nozzle sleeve 221 thereto. The outlets 22 disposed at both end sides thereof are symmetrically arranged to incline in a sequence towards the outer sides thereof, and multiple control channels 23 each connecting to the interior of the tube 20 are disposed extending at both end sections of the platform 21 thereon. Each control channel 23 (referring to FIG. 4) is conjoined to the internal plane surface 211 of the platform 21 with a stop portion 24 formed there-between at both internal sides respectively. And each control rod 30, extending through the control channel 23 and movably slid therein, is equipped with a flat surface 31 defining one side thereon to keep an appropriate space from the internal surface of the platform 21 thereof and precisely correspond to the outlet 22 thereof. One end of the control rod 30 has a stop head 32 with an annular groove 321 defining thereon for the mounting of a watertight hoop 33 thereto, and the other end of the control rod 30 has a coupling section 34 with flexible insert hooks 341 extending thereon to reciprocally fit to a stop sheath 35 with insert holes 351 defining thereon. The stop head 32 and stop sheath 35, respectively situated at the outer sides of the stop portions 24, are actuated by the movement of the control rod 30 to abut against the stop portions 24 and restricted in position thereby. The plane surface 31 of each control rod 30 has a positioning groove 311 indented thereon for the accommodation of a water-sealing member 36 thereto, and a hole-like water-intake area 312 defining thereon. The water-sealing member 36 can be molded into a ringed shape or other configurations, and is made of flexible plastic material to slightly bulge on the flat surface 31 thereon so as to precisely abut tight against the internal plane surface 211 of the platform 21 thereby. The nozzle housing 40 is applied to cover on top of the tube 20, having multiple positioning passages 41 drilled on the top surface to correspond to the outlets 22 thereof so that the nozzle sleeves 221 are allowed to extend outwards through the positioning passages 41 as shown in FIG. 5 and the nozzle sleeves 221 mounted at both end sections thereon are naturally guided along the oblique outlets 22 to incline sequentially towards both outer sides in an expanding manner.

Figure 6:
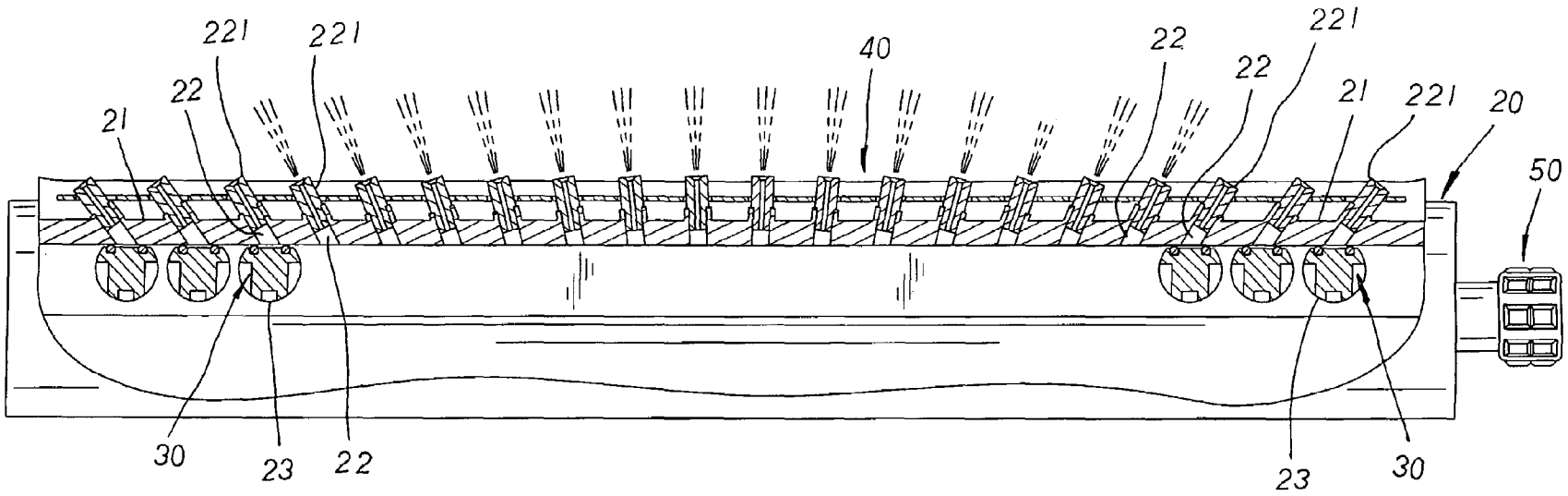
FIG. 6 is a diagram showing a reduced number of outlets opened for sprinkling as shown in FIG. 4.
Figure 7:
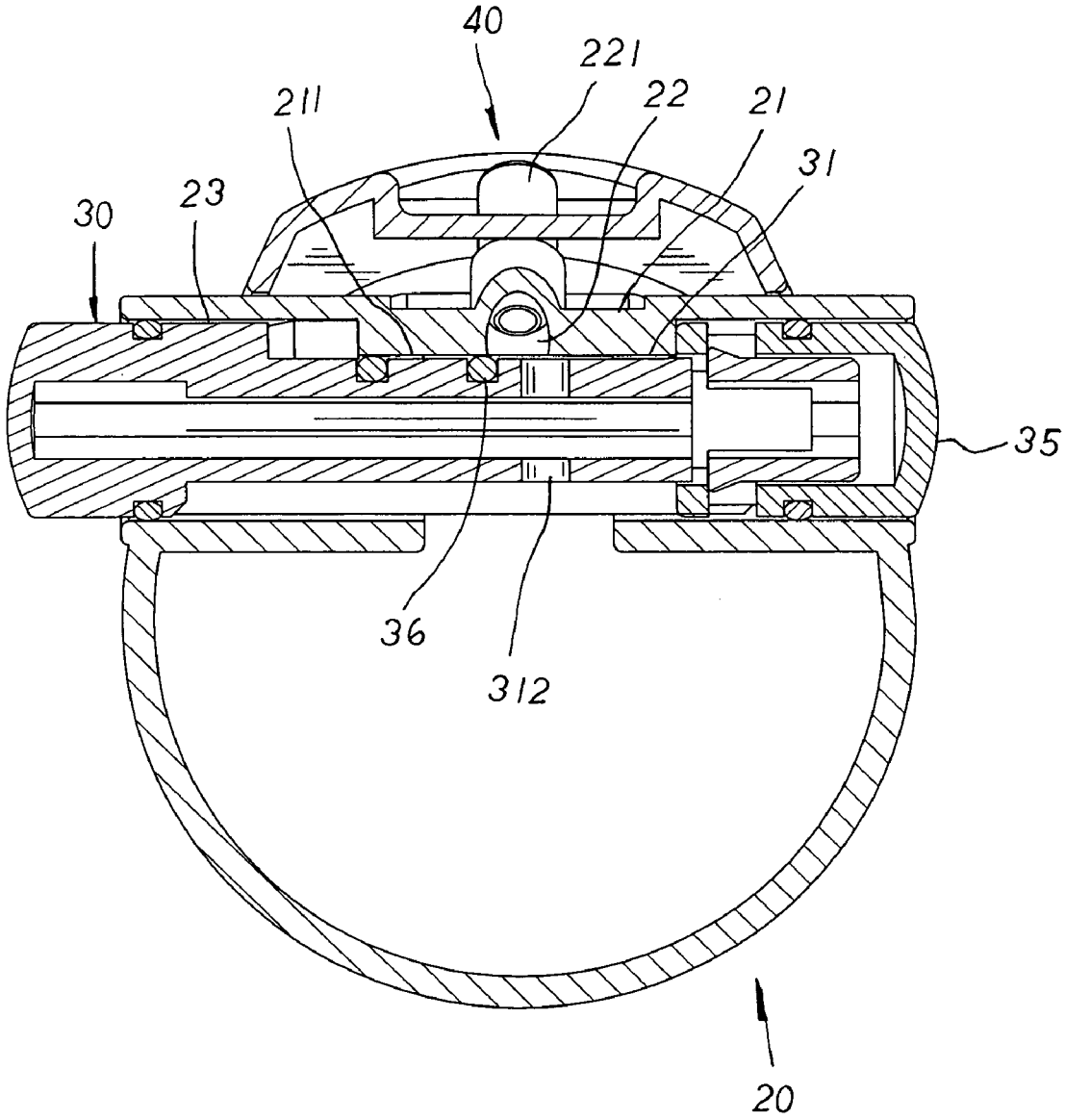
FIG. 7 is an assembled cross sectional view of the present invention opened in a state of water discharge.
Figure 8:
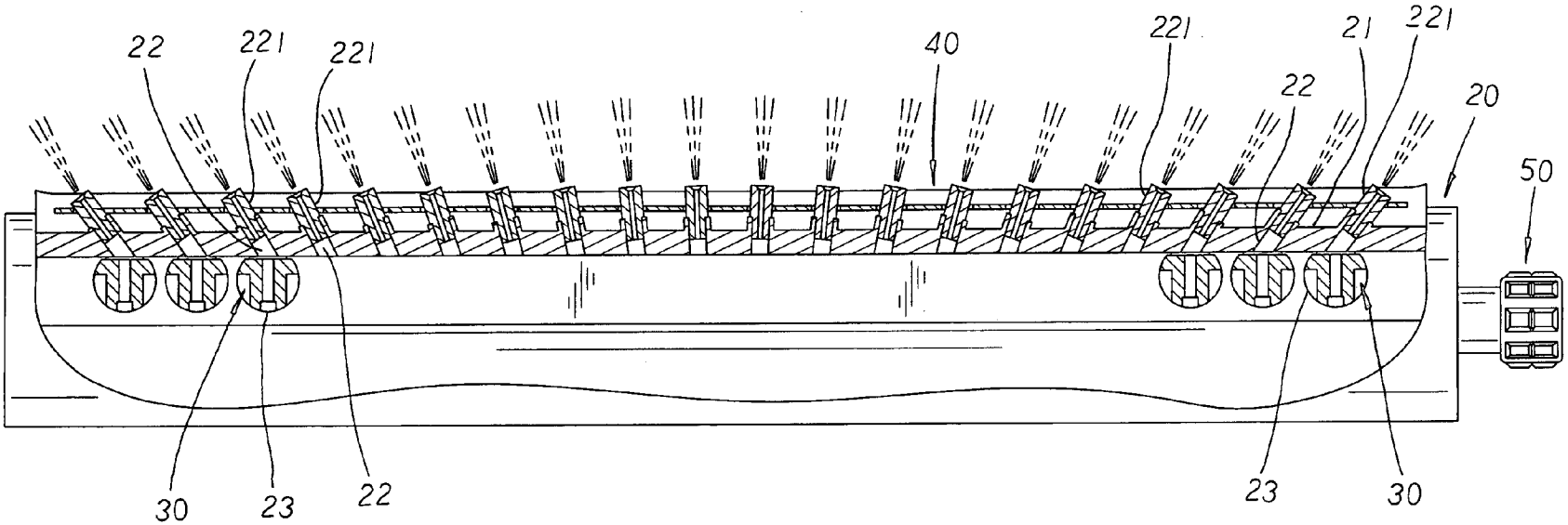
FIG. 8 is a diagram showing an increased number of the outlets opened for sprinkling as shown in FIG. 7.

When the control rod 30 is pushed towards one side till the water-sealing member 36 and the outlet 22 are corresponded to each other (referring to FIG. 4), the outer periphery of the outlet 22 will be blocked up by the water-sealing member 36 to close the water discharge in a shutoff state so as to cut down the number of the nozzle sleeves 221 with the outlets 22 for sprinkling as shown in FIG. 6. And, when the control rod 30 is pushed towards the other side till the water-intake area 312 and the outlet 22 are corresponded to each other (referring to FIG. 7), the outlet 22 will be opened up in a discharge state so that the water flow collected in the tube 20 thereof will pass through the water-intake area 312 of the control rod 30 to enter the nozzle sleeve 221 and emit outwards there-from, augmenting the number of the outlets 22 for sprinkling as shown in FIG. 8 and flexibly changing the number of the outlets 22 opened for water discharge thereby. Besides, the flat surface 31 of the control rod 30 is kept in an appropriate space from the internal plane surface 211 of the platform 21 with only the water-sealing member 36 being closely abutted against therewith to control the shutoff and discharge of the water flow so that the contact area between the control rod 30 and the internal plane surface 211 of the platform 21 thereof can be reduced and the frictional coefficient thereof can be relatively cut down thereby. Thus, the control rod 30 can be smoothly operated in an easy and efforts-saving manner. Furthermore, the water-sealing member 36 is sandwiched between the flat surface 31 of the control rod 30 and the internal plane surface 211 of the platform 21 thereof in flat abutment therewith, permitting the water-sealing member 36 to flatly and evenly contact watertight with the internal plane surface 211 of the platform 21 no matter in high or low water pressure so as to avoid the risk of water leakage via the outlets 22 in case of high water pressure and to achieve better waterproof effect thereby.

Figure 9:
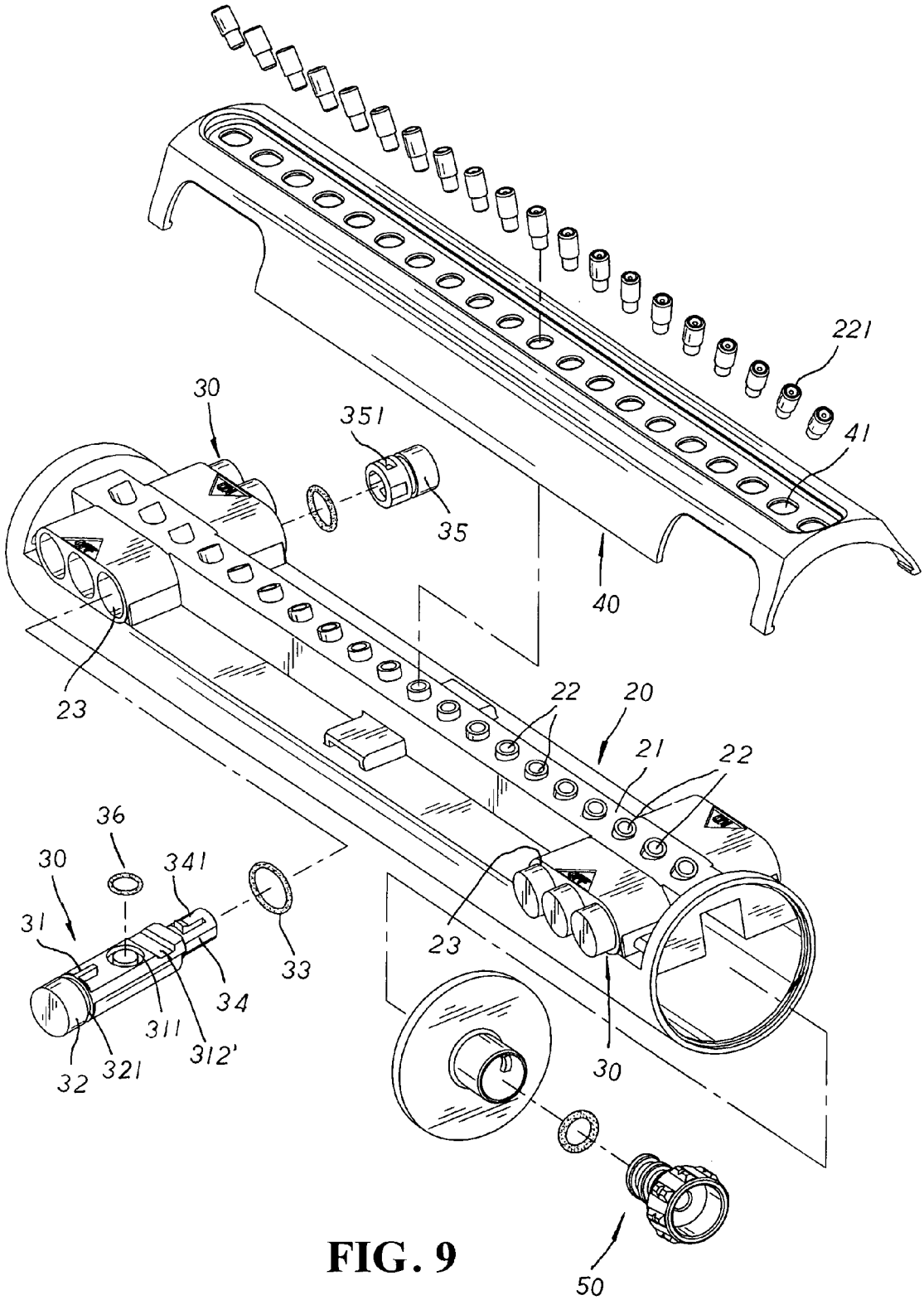
FIG. 9 is an exploded perspective view of another embodiment of the present invention.
Figure 10:
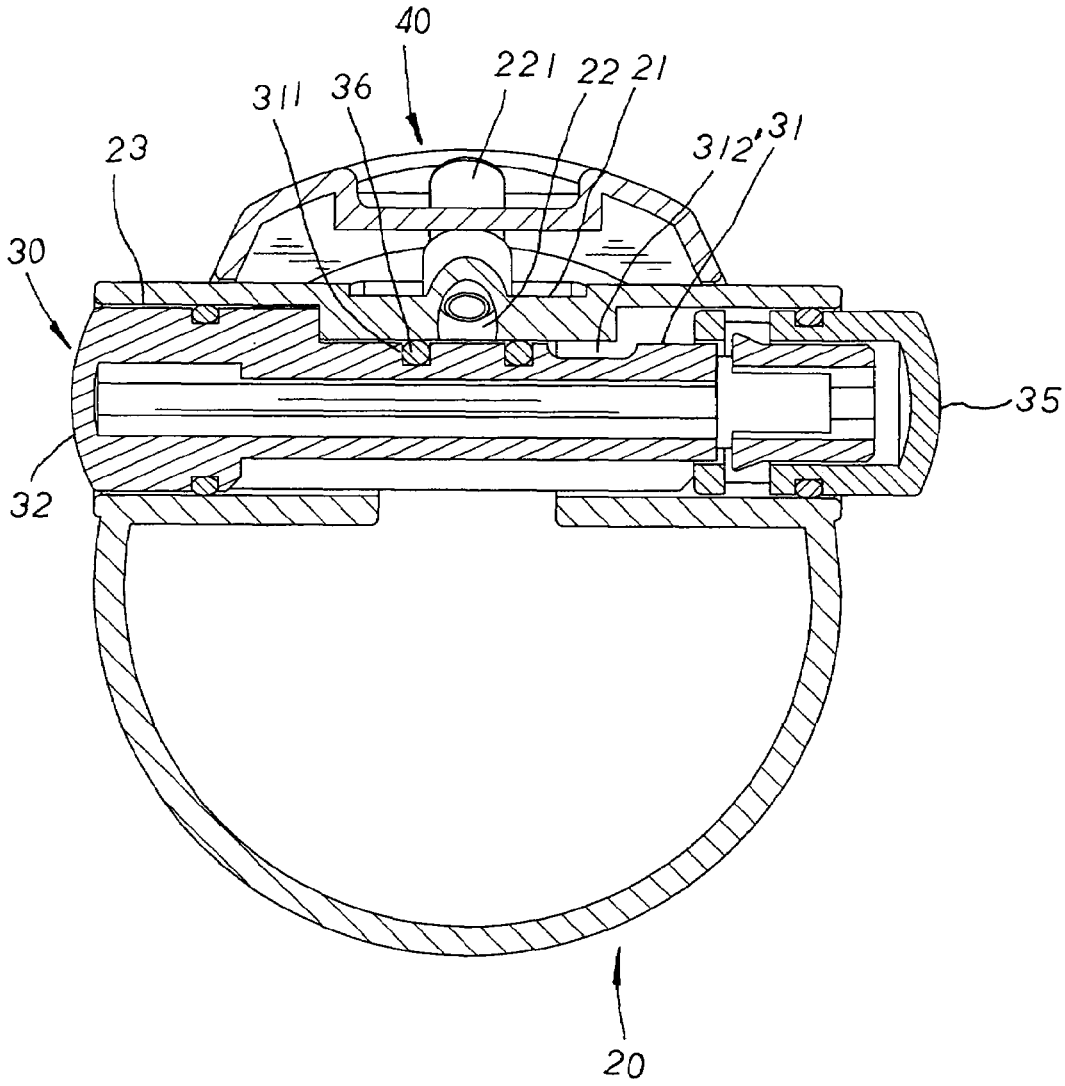
FIG. 10 is an assembled cross sectional view of FIG. 9 closed in water discharge.
Figure 11:
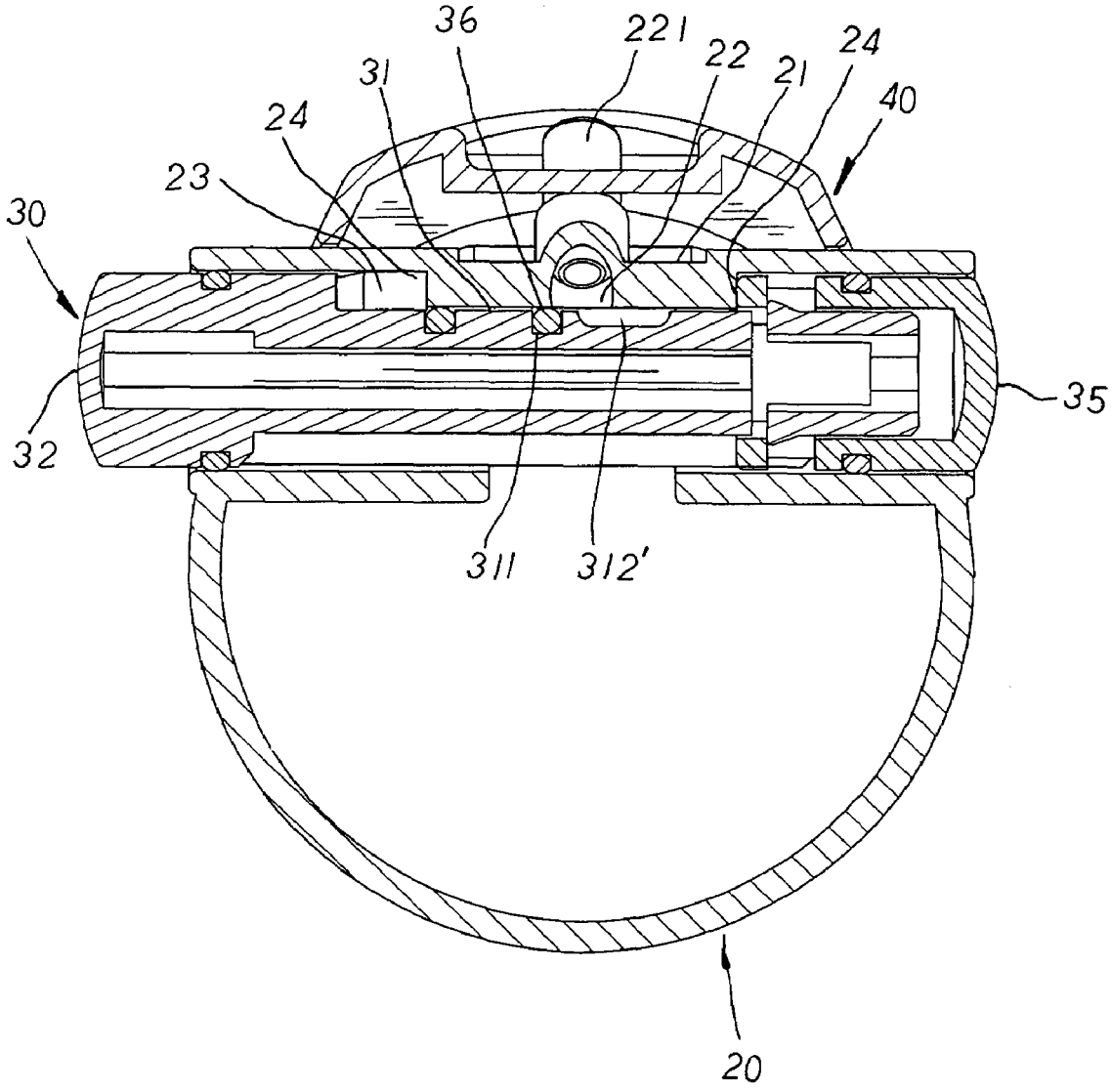
FIG. 11 is an assembled cross sectional view of FIG. 9 opened in a state of water discharge.

Please refer to FIG. 9. Each control rod 30 of the present invention can also have a water-intake area 312' molded in a groove-like configuration. And, when the control rod 30 is pushed towards one side till the water-sealing member 36 and the outlet 22 are corresponded to each other as shown in FIG. 10, the outer periphery of the outlet 22 will be blocked up by the water-sealing member 36 to form a water shutoff state thereby so as to reduce the number of the nozzle sleeves 221 with the outlets 22 opened for water discharge. And when the control rod 30 is pushed towards the other side till the water-intake area 312' and the outlet 22 are corresponded to each other as shown in FIG. 11, the outlet 22 will be opened up for the water flow collected in the tube 20 to pass through the water-intake area 312' and enter the nozzle sleeve 221 for sprinkling outwards there-from, increasing the number of the nozzle sleeves 221 for water discharge and, thus, flexibly changing the number of the outlets 22 opened for sprinkling thereby.

What is claimed is:

1. A water shutoff and discharge control apparatus for sprinklers, comprising a sprinkler, and a water intake apparatus equipped with a tube with a top side defined by a platform wherein the platform has a plane surface defining the internal wall thereon with a plurality of outlets drilled thereon, and both end sections of the platform thereof are provided with multiple control channels each communicating with the tube for the extension there-through of a control rod having a flat surface defining thereon; the flat surface of the control rod is kept in an appropriate space from the internal plane surface of the platform and is located to precisely correspond to the outlet thereof; the flat surface of each control rod also has a water-sealing member mounted thereto and a water-intake area defining thereon, wherein the water-sealing member is so accommodated as to slightly bulge on the flat surface of the control rod thereon and precisely in tight and close abutment against the internal plane surface of the platform thereof; whereby, depending on the movement of the control rod thereof, the water-sealing member and the water-intake area thereof are synchronically switched in position to respectively correspond to the outlet so as to achieve the control of water discharge and shutoff.

2. The water shutoff and discharge control apparatus for sprinklers as claimed in claim 1 wherein the water-intake area of each control rod can be made in a hole-like shape.

3. The water shutoff and discharge control apparatus for sprinklers as claimed in claim 1 wherein the water-intake area of the control rod thereof can also be made in a groove-like shape.

4. The water shutoff and discharge control apparatus for sprinklers as claimed in claim 1 wherein the flat surface of the control rod can have a positioning groove indented thereon for the accommodation of the water-sealing member thereto.

5. The water shutoff and discharge control apparatus for sprinklers as claimed in claim 1 wherein the water-sealing member thereof can be molded into a ringed shape or other configurations.

6. The water shutoff and discharge control apparatus for sprinklers as claimed in claim 1 wherein the water-sealing member can be made of flexible plastic material.

7. The water shutoff and discharge control apparatus for sprinklers as claimed in claim 1 wherein each outlet of the tube can have a nozzle sleeve mounted thereto.

8. The water shutoff and discharge control apparatus for sprinklers as claimed in claim 1 wherein on top of the tube can be mounted a nozzle housing with multiple positioning passages disposed thereon.

9. The water shutoff and discharge control apparatus for sprinklers as claimed in claim 1 wherein the outlets arranged at both end sections of the tube can be symmetrically arranged to incline sequentially towards the outer sides in an expanding manner.

10. The water shutoff and discharge control apparatus for sprinklers as claimed in claim 1 wherein each control channel of the tube is conjoined to the internal plane surface of the platform thereof with a stop portion formed there-between at both internal sides respectively.

11. The water shutoff and discharge control apparatus for sprinklers as claimed in claim 1 wherein a stop head defined by an annular groove for the accommodation of a watertight hoop thereto is disposed at one end section of each control rod thereof, and the other end of the control rod has a coupling section equipped with flexible insert hooks thereon to fit to a stop sheath defined by insert holes thereon.

* * * * *